US006321665B1

(12) United States Patent
Uchida

(10) Patent No.: US 6,321,665 B1
(45) Date of Patent: Nov. 27, 2001

(54) INCINERATOR FOR WASTE MANAGEMENT

(75) Inventor: Yotaro Uchida, Kokubunji (JP)

(73) Assignee: Evergreen Planet SDN BHD (MY)

( * ) Notice: Subject to any disclaimer, the term of this patent is extended or adjusted under 35 U.S.C. 154(b) by 0 days.

(21) Appl. No.: 09/678,568

(22) Filed: Oct. 3, 2000

(30) Foreign Application Priority Data

Oct. 4, 1999 (JP) ..... 11-282888

(51) Int. Cl.[7] ..... F23G 5/44; F23G 7/00

(52) U.S. Cl. ..... 110/235; 110/251; 110/234; 110/297; 110/309; 110/348

(58) Field of Search ..... 110/251, 252, 110/233, 234, 235, 205, 297, 301, 302, 309, 314, 396, 348; 126/146, 112

(56) References Cited

U.S. PATENT DOCUMENTS

| | | | | |
|---|---|---|---|---|
| 282,035 | * | 7/1883 | Baker | 110/297 |
| 1,106,093 | * | 8/1914 | Hahle | 110/297 |
| 3,369,505 | * | 2/1968 | Reusser | 110/8 |
| 3,457,883 | * | 7/1969 | Ankersen | 110/10 |
| 4,278,034 | * | 7/1981 | Reale | 110/234 |
| 4,306,506 | * | 12/1981 | Rotter | 110/229 |
| 4,311,103 | * | 1/1982 | Hirose | 110/238 |
| 5,009,173 | * | 4/1991 | Temelli | 110/244 |
| 5,177,953 | * | 1/1993 | Firey | 60/39.12 |
| 5,836,258 | * | 11/1998 | Ruegg et al. | 110/346 |
| 6,058,622 | * | 5/2000 | Sandor | 34/339 |
| 6,058,857 | * | 5/2000 | Nakai et al. | 110/245 |

OTHER PUBLICATIONS

U.S. application No. 09678568, Sanbonmatsu, filed Jan. 1997.*

* cited by examiner

*Primary Examiner*—Pamela Wilson
*Assistant Examiner*—K. B. Rinehart
(74) *Attorney, Agent, or Firm*—Wiggin & Dana

(57) ABSTRACT

A waste management incinerator has a combustion chamber with a number of U-shaped air supply pipes protruding toward the chamber center. A number of air supply branch pipes are installed on the air supply pipes for supplying air to the combustion chamber to form a vortex-like current circulating in the combustion chamber so as to minimize imperfect combustion. Each air supply pipe is double-structured, having a water pipe connected to an air chamber with the air supply branch pipes located inside penetrating through the water pipe.

10 Claims, 4 Drawing Sheets

INCINERATOR FOR WASTE MANAGEMENT

BACKGROUND OF THE INVENTION (1) Field of the Invention

The present invention relates in general to an incinerator for use in waste management.

(2) Description of the Related Art

Occurrence of toxic substances including dioxin has become a major problem when industrial wastes and other wastes are incinerated. One of the known incinerators has a main body in which is installed an air-heating pipe on the top of a combustion chamber and air supply pipes at the bottom of the combustion chamber. Each air supply pipe is double structured, consisting of an outer water pipe and an inner pipe. In this incinerator, compressed air heated in the air-heating pipe will be blown out from the air supply pipes and circulate in the combustion chamber when it is blasted out from the air supply branch pipes and the water pipes.

The lower half of the incinerator main body is covered with an air chamber cell casing, and an air chamber which is connected to the combustion chamber by auxiliary air supply branch pipes that protrude from a water jacket. The auxiliary air supply branch pipes are installed parallel to the height of the incinerator main body. Air which is blown out from the auxiliary air supply pipes further supplies oxygen to the combustion chamber and blows off the ashes of the combusted waste. Air can easily be supplied to the furnace bottom, furnace wall and furnace center from the air supply branch pipes installed on the furnace bottom and the walls if the furnace is small in size. However, air does not reach the furnace center if the incinerator becomes large in size, which results in imperfect combustion due to a lack of oxygen, especially if the air blown out from the walls is blocked by ascending currents of the flames generated in the furnace, which results in poor combustion efficiency.

Imperfect combustion causes the generation of ashes of toxic substances including dioxin that has become a critical issue that needs to be addressed. Furthermore, wastes of different forms, such as liquid, sludge, high moisture wastes, and solid liquefaction burning, require different incinerators.

BRIEF SUMMARY OF THE INVENTION

The incinerator provides combustion efficiency for various wastes of various forms, and seeks to minimize generation of dioxin and imperfect combustion. This will enable the incinerator to operate continuously, even if the incinerator is large.

Accordingly, it is a primary object of the present invention to provide an incinerator for use in a variety of forms of waste management.

According to one aspect of the present invention, there is provided an incinerator for use in waste management comprising a combustion chamber located in the incinerator having, a plurality of U-shaped air supply pipes protruding toward the center of the combustion chamber for air to be well supplied to the combustion chamber so as to enhance combustion, and a plurality of air supply branch pipes are installed on one side of the air supply pipes for maintaining air circulation in the combustion chamber.

Preferably, the air supply branch pipes are located on the upper and lower end portions of the air supply pipes.

Also, preferably, pairs of diametrically opposed air supply branch pipes may be installed spaced equidistantly along central vertical portions of the air supply pipes. Alternating pairs may be staggered at right angles to each other. For example, one pair may be oriented radially and the adjacent pair(s) oriented circumferentially in an exemplary round chamber.

Alternatively, groups of four air supply branch pipes may be installed spaced equidistantly along the central vertical portion of the air supply pipe. The groups may be staggered with, adjacent groups oriented rotated approximately 45° about the air supply pipe.

Preferably, the air supply pipe is double structured having a water pipe connecting the air supply pipe to a water jacket and an inner pipe mounted inside the water pipe which is connected to an air chamber. The air supply branch pipes extend from the inner pipe and penetrate the water pipe.

Preferably, an air-heating pipe is installed on top of the incinerator for enabling high temperature and compressed air to be supplied into the combustion chamber and the air-heating pipe and the combustion chamber are linked with the air supply pipes.

Also, preferably, a steam generator is installed on top of the incinerator for enabling steam to be supplied into the combustion chamber and the steam generator and the combustion chamber are linked with the air supply pipes.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

An illustrative embodiment of the invention is represented in the drawings and described in greater detail in the following description, in which drawings.

DETAILED DESCRIPTION

Figure 1:
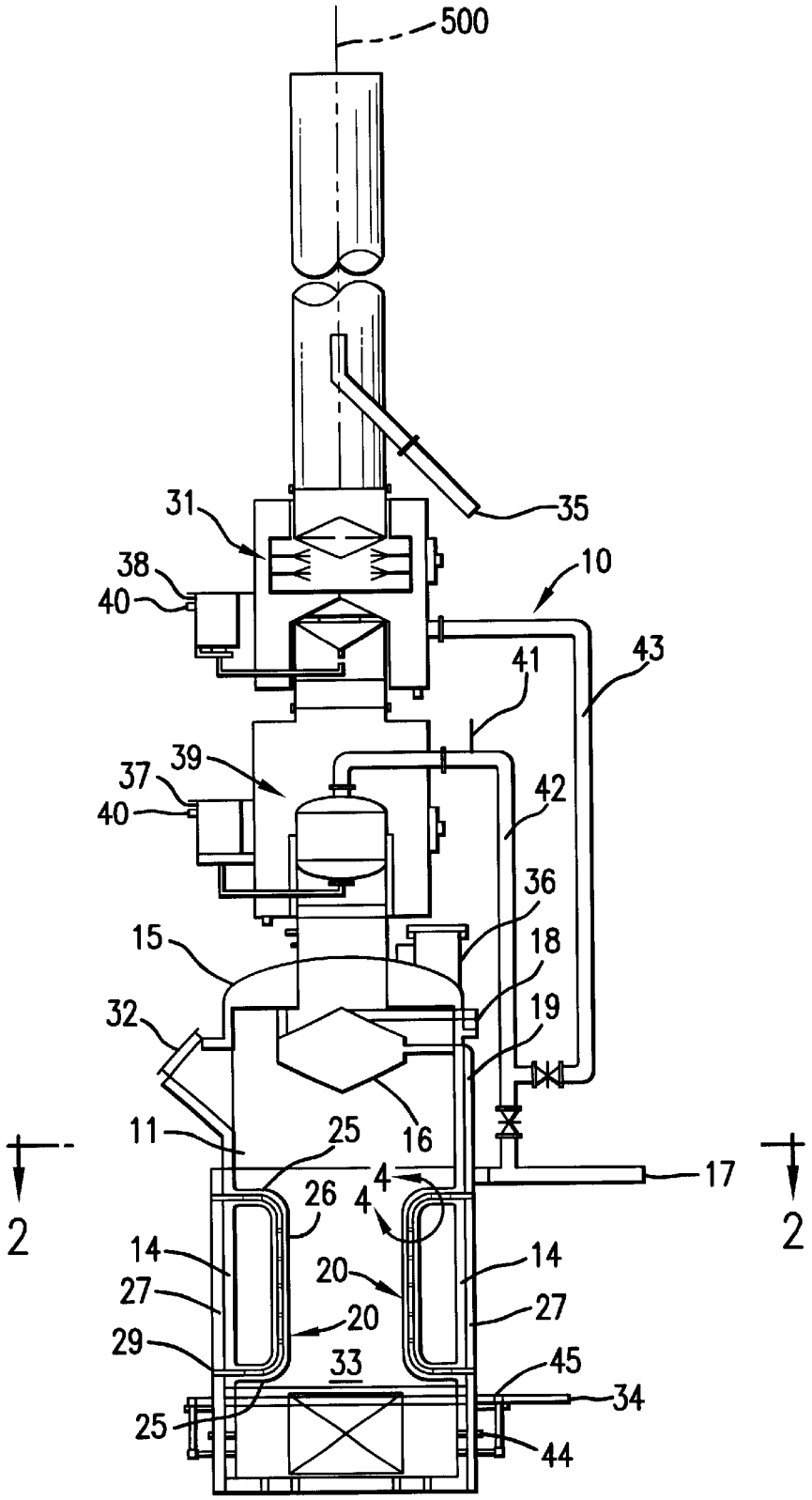
FIG. 1 shows a vertical cross section of an incinerator according to principles of the invention.

Referring to the drawings, the incinerator 10 (FIG. 1) includes a combustion chamber 11 surrounded by an inner or interior wall 12 (FIG. 4) and an outer or exterior wall 13 and a water jacket 14, which is located in between the inner and outer walls. An air-heating pipe 16 (FIG. 1) is installed on the top center of the combustion chamber 11 in the incinerator main body 15, which enables air from a blower 17 to be heated. The upper end of the air-heating pipe 16 is connected to the blower or an external air supply pipe 18 extending from another separate blower (not shown). The lower end of the air-heating pipe 16 is connected to the end of hot air supply pipe 19 extending upward along the exterior wall of the incinerator main body 15, and the other end of the hot air supply pipe 19 penetrates through an air chamber 27 and is connected to U-shaped air supply pipes 20 in the combustion chamber 11.

Each air supply pipe 20 is double structured. Each air supply pipe 20 includes an outer water pipe 22 in which water flows, and both ends of the water pipe are connected to the water jacket 14. The water pipe 22 functions as an outer jacket, covering an inner pipe 21 concentrically installed inside the water pipe. Both ends of the inner pipe 21 are connected to the air chamber 27 and are also installed with air supply branch pipes 23 and 24 shown in (FIGS. 2 to 4) extending through the water pipe to permit air flow out of the inner pipe.

The air supply pipes 20 comprise one upper and one lower horizontal portion 25 and one vertical portion 26 therebetween. Three air supply branch pipes 23 are installed on one side (e.g., the counterclockwise-facing side when viewed from above) of the inner pipe 21 in each horizontal portion 25 of the air supply pipes. This allows air to be continuously blown out in a certain direction about the central axis 500 (e.g., counterclockwise as viewed from above). Therefore, the air blown out from the air supply branch pipes 23 forms a circulation of air in the combustion chamber 11 as shown by arrow 28 in FIG. 2. The circulated air enhances combustion of industrial and other wastes.

Figure 4:
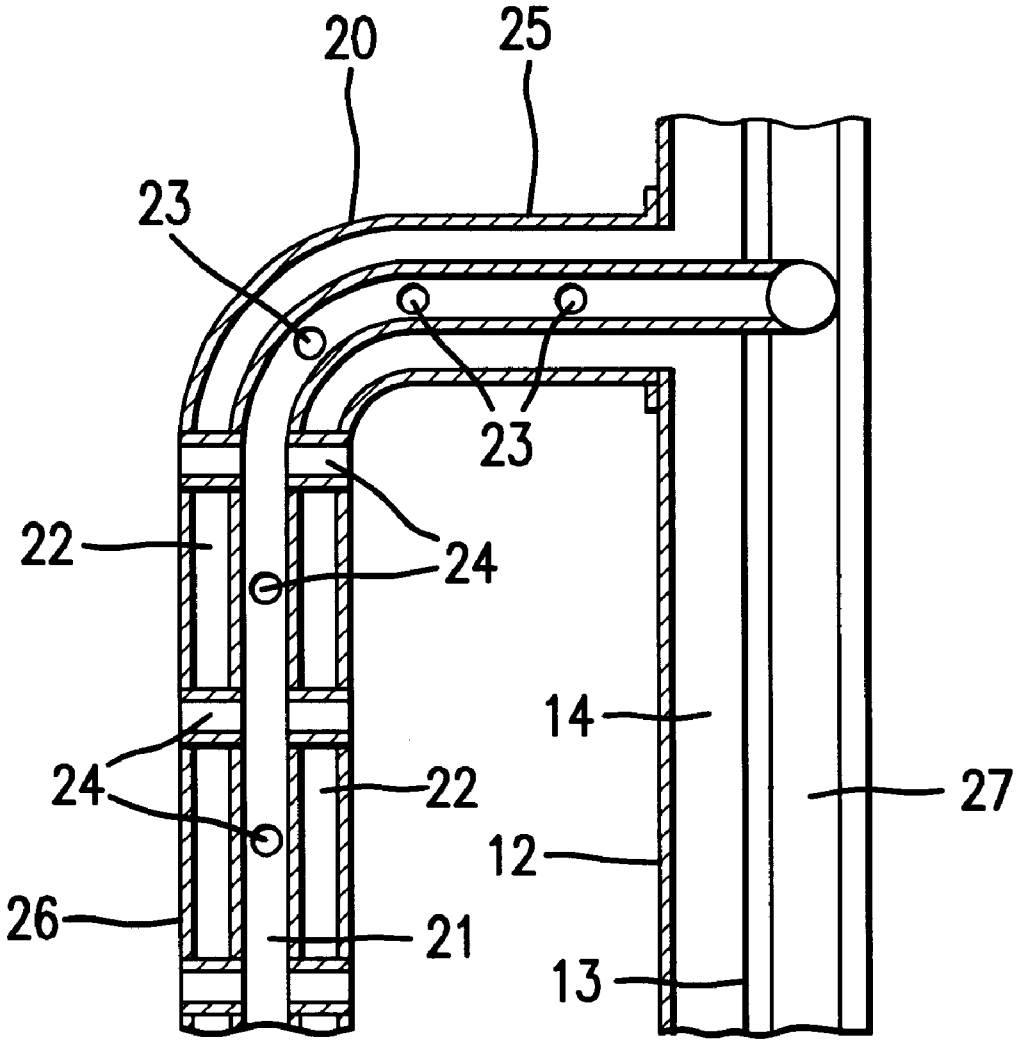
FIG. 4 shows an enlarged vertical cross section of the air supply pipes in the incinerator of FIG. 1.

The air supply branch pipes 24 are horizontally and vertically staggered on the inner pipes 21 of the vertical portions 26 of the air supply pipes 20. By way of example, FIG. 4 shows alternating staggered pairs of air supply branch pipes 24. Each pair is diametrically opposed in alternating radial and circumferential directions about the center of the incinerator. Thus air is blown out in four directions, with a net effect being substantially no net directional flow.

In another exemplary embodiment (not shown), groups of four air supply branch pipes are horizontally installed spaced equidistantly along the inner pipe of the vertical portion of each air supply pipe. The adjacent group(s) of four air supply branch pipes are staggered at approximately 45° angles about the inner pipe, which enables air to be blown out in eight directions.

In another exemplary embodiment (not shown), groups of eight air supply branch pipes are horizontally installed spaced equidistantly along the inner pipe of the vertical portion of each air pipe. More air supply branch pipes are vertically staggered but commonly aligned so that air is blow out in eight directions.

The area surrounded by the air supply pipes 20 forms the center of the combustion chamber 33. The space in the combustion chamber 33 helps flames circulate sufficiently which enhances combustion efficiency and enables waste to be easily disposed in the combustion chamber 11. The space of the central area of the combustion chamber 33 is formed within an area where air blown out from the air supply pipes 20 and air supply branch pipes 24 installed on the vertical portions 26 is able to reach.

An air chamber cell casing 29 (FIG. 1) covers the outer lower half of the incinerator main body 15. The air chamber 27 inside the casing 29 is connected to the combustion chamber 11 by the inner pipes 21, which penetrate through the water jacket 14. Compressed air is supplied to the combustion chamber 11 by the air supply branch pipes 23 and 24.

A second air chamber cell casing 44 covers the outer lower side of the incinerator main body 15. The air chamber 45 inside the casing 44 is connected to the combustion chamber 11 by auxiliary air supply branch pipes 30, which penetrate through the water jacket 14.

Figure 2:
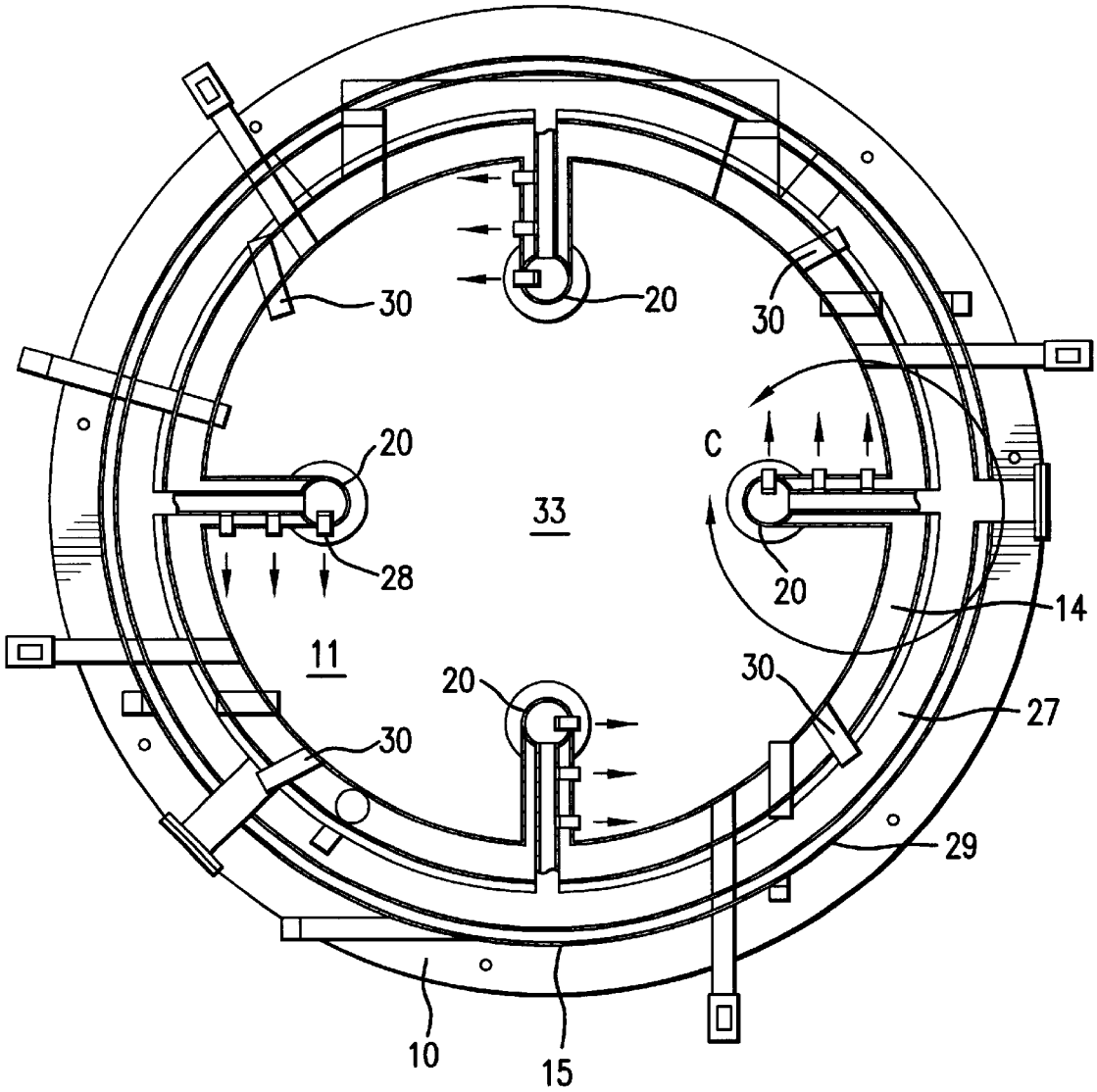
FIG. 2 shows a horizontal cross section of the combustion chamber of FIG. 1, taken along line 2—2.
Figure 3:
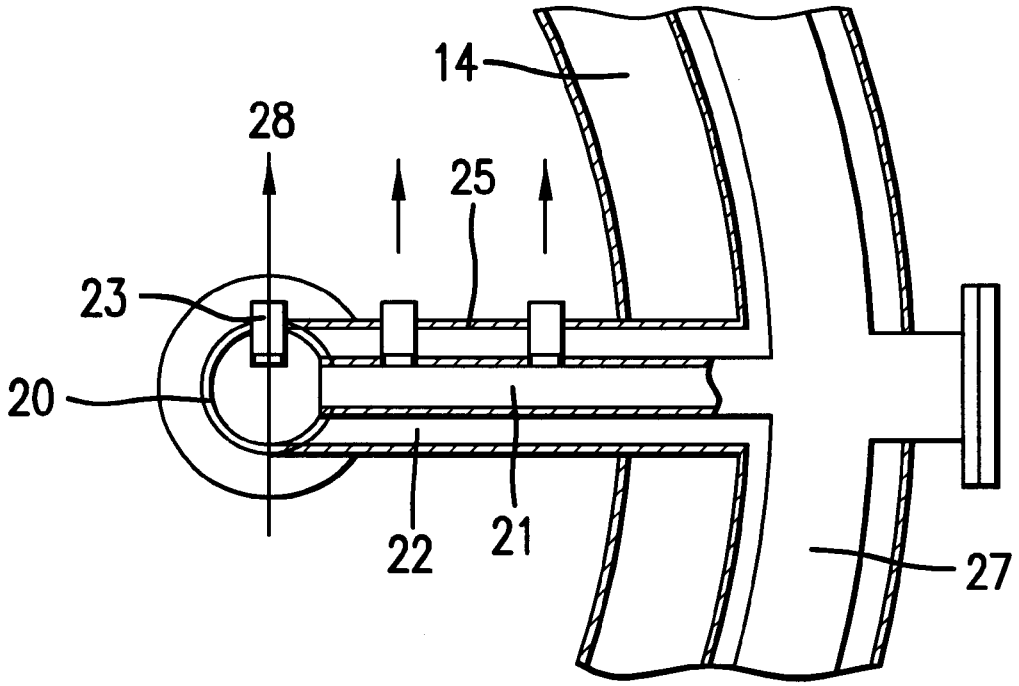
FIG. 3 shows an enlarged horizontal cross section of the air supply pipes in the incinerator of FIG. 1.

The auxiliary air supply branch pipes 30 extend along the main body until the top of the incinerator main body as shown in FIG. 2. The air blown out from the auxiliary air supply pipes 30 in the combustion chamber 11 supplies oxygen and blows ashes upward. This enables complete combustion of non-combusted gas resulting in high combustion efficiency. The ashes blown upward are collected by the dust remover device 31 which is installed on top of the incinerator main body 15. Thus it is not necessary to manually remove ashes from the combustion chamber 11.

A port 32 for disposing of industrial and other wastes is mounted on top of the incinerator main body 15, which forms an upper portion of the air chamber cell casing 29. Industrial and other wastes are constantly fed through the port 32 by a belt conveyor (not shown) to be supplied to the combustion chamber 11.

Air can be supplied to the air chamber 27 in the air chamber cell casing 29 by using the blower 17 or other compressed air supply source that supplies compressed air to the air-heating pipe 16. Pressure reduction valves may be required in piping in order to keep air pressure supplied to the air chamber cell casing 29 lower than air pressure supplied to the air-heating pipe 16 if blower 17 is shared.

A blower 34 that supplies compressed air to an air chamber 45 connected to an auxiliary air supply branch pipes 30 is shown in FIG. 1. A blower 35 that supplies air to an exhaust flue and helps ventilation of the incinerator 10 is also shown in FIG. 1. Also in FIG. 1, a system tank is shown as 36, a second system tank is shown as 37, a third system tank is shown as 38, while a steam generator is shown as 39. High temperature compressed steam is mixed with compressed air and supplied to the combustion chamber 11, which will enhance combustion efficiency. In other words, steam mixed with compressed air blown out from the air supply pipes 20 will enhance rotation of the flames and enhances combustion efficiency in the combustion chamber 11. A pump is shown as 40, a safety valve as 41, and a plurality of supply pipes that supply steam to the air chamber 27 are shown as 42 and 43.

The operational functions of the incinerator shall be described as follows:

Industrial and other wastes are disposed at the bottom of a combustion chamber 11 of the incinerator main body 15. Industrial and other wastes fed into the port 32 are received at the bottom part of the combustion chamber 11. Compressed air that passes through a double strictured air supply pipe 20 is supplied from a blower 17. Alternately, high-temperature compressed air supplied from an air-heating pipe 16 installed on top of the combustion chamber 11 is mixed with compressed air supplied from the blower 17 and the mixed air is supplied into the combustion chamber 11. In addition to the above mentioned supply system, steam supplied from the steam generator 39 which is installed on the upper side of the incinerator 15 is mixed with compressed air and supplied to the combustion chamber 11. When the mixed air is supplied, air supplied from the air supply branch pipes 23 installed on the upper and lower horizontal sides 25 of the air supply pipes 20 will be blown out in constant directions at all time, so that compressed air and/or heated compressed air will form a vortex-like current, circulating in the combustion chamber 11, which will accelerate combustion.

The double structured air supply pipes are installed protruding toward the center of the combustion chamber. Hot and compressed air blows out from the air supply pipes which generates air flow in a certain direction and there is additional air blown out in all 360° directions in the combustion chamber (i.e., in substantially no net direction). As a result, air circulation enhances combustion and air will be supplied to all parts of the combustion chamber including the furnace walls and center, which will minimize generation of dioxin and imperfect combustion. At the same time, ashes will not accumulate and combustion efficiency will dramatically improve, enabling the incinerator to be operated continuously.

Compressed air is blown out nondirectionally, in addition to the air circulation, as air supply branch pipes are horizontally and vertically staggered on the vertical portions of the air supply pipes. This helps oxygen to be supplied to all parts of the combustion chamber, which will maintain optimal combustion.

The temperature in the furnace does not drop as the compressed air blown out from the air supply branch pipes 23 and 24 is heated in the air-heating pipe 16 installed on top of the combustion chamber 11. Additionally, the air blown out from the air supply branch pipes 23 generates a large air circulation throughout the combustion chamber 11, which will dramatically improve combustion efficiency.

Steam generated in the steam generator installed on top of the incinerator main body and mixed with compressed air is supplied to the combustion chamber, which will increase combustion efficiency. In other words, the mixture of compressed air blown out from the air supply pipes and steam enables stronger turning force (i.e., increased rotation) of the flame and enhances combustion in the combustion chamber.

Oxygen is supplied fully in the combustion chamber 11 as heated and compressed air is blown out from the air supply branch pipes 24 vertically and horizontally staggered on the vertical portion 26 of the air supply pipes 20. Although oxygen is often lacking in the center of the combustion chamber in an existing large incinerator, a large volume of oxygen can be supplied to the center of the combustion chamber of the present incinerator as air supply pipes are installed protruding inward toward the center of the combustion chamber. As a result, the combustion temperature will rise and combustion efficiency will improve, which will bring higher combustion volumes and less generation of dioxin and imperfect combustion.

Residual ashes produced by combustion are blown upward from the bottom of the incinerator when compressed air blown out from the air supply pipes 20 circulates. The ashes that are blown upward are collected in a dust removal device 31. As a result, ashes do not need to be manually removed from the combustion chamber. Only incombustible substances need to be collected. Therefore, this incinerator is suited for use in long continuous operation.

Moreover, by a built-in device that can store the liquid inside the combustion chamber, the incinerator can handle a variety of forms of waste.

In the air supply pipes 20, the inner pipe 21 is protected by the water pipe 22. The water running inside the water pipe also protects the water pipe from an extreme temperature rise, which will help avoid heat deterioration. Therefore, the pipes will not be damaged by the shock of feeding industrial and other wastes.

In the operational functions of the invention, the combustion treatment of the industrial and other wastes had been explained. However, this invention is not limited only in treating industrial and other wastes but can be applied to any combustible wastes.

While the preferred embodiments of the present invention and their advantages have been disclosed in the above detailed description, the invention is not limited thereto but only by the spirit and scope of the appended claims.

What is claimed is:

1. An incinerator for use in waste management comprising:

a combustion chamber located in the incinerator;

a plurality of U-shaped air supply pipes protruding toward the center of the combustion chamber;

a plurality of air supply branch pipes installed on said air supply pipes for supplying air into the combustion chamber to form a vortex-like current circulating in the combustion chamber so as to minimize imperfect combustion; and a plurality of outer pipes respectively associated with the plurality of air supply pipes and air supply branch pipes, wherein said air supply pipes and air supply branch pipes are concentrically installed within said associated outer pipes through which water flows for the purpose of cooling said air supply pipes and air supply branch pipes.

2. The incinerator according to claim 1 wherein the air supply branch pipes are located on upper and lower portions of the air supply pipes for keeping air to be blown out as well as helping air circulation in the combustion chamber.

3. The incinerator according to claim 1 wherein pairs of air supply branch pipes are installed spaced equidistantly on the air supply pipes staggered at right angles to adjacent pair(s) for enabling air to be blown out in four directions into the combustion chamber.

4. An incinerator for use in waste management comprising:

a combustion chamber located in the incinerator and having a plurality of U-shaped air supply pipes protruding toward the center of the combustion chamber supplying air into the combustion chamber so as to minimize imperfect combustion; and a plurality of air supply branch pipes installed on one side of the air supply pipes for maintaining air to be blown out in various directions and circulated in the combustion chamber;

wherein an air-heating pipe is installed on top of the incinerator for enabling high temperature and compressed air to be supplied into the combustion chamber and the air-heating pipe and the combustion chamber are linked with the air supply pipes which are oriented toward the center of the combustion chamber.

5. The incinerator according to claim 1 wherein a steam generator is installed on top of the incinerator for enabling steam to be supplied into the combustion chamber and the steam generator and the combustion chamber are linked with the air supply pipes oriented toward the center of the combustion chamber.

6. An incinerator for use in waste management comprising:

a combustion chamber (11) surrounded by an inner wall (12) and having a central longitudinal axis (500); and a plurality of air supply pipe units (20) each having a central longitudinally-extending portion (26) within the chamber and first and second portions (25) extending from the central portion (26) to the wall (12), and comprising:

an outer pipe (22);

an inner pipe (21);

branch pipes (23; 24) extending from the inner pipes and penetrating the associated outer pipes;

a space between the outer pipe and the inner pipe carrying water for cooling; and outlets defined by terminal portions of the branch pipes, the outlets admitting air into the chamber with a net circulation about the central longitudinal axis effective to enhance combustion within the chamber.

7. The incinerator of claim 6 wherein the outlets include a plurality of first outlets on at least one of the end portions of the air supply pipe units effective to provide said circulation and a plurality of second outlets along said longitudinally-extending portions producing substantially no net circulation about said central longitudinal axis.

8. The incinerator of claim 7 wherein the first outlets are formed by first branch pipes (23) and the second outlets are formed by second branch pipes (24) extending between the inner and outer pipes.

9. The incinerator of claim 6 wherein said spaces carrying water communicate with a water jacket (14) outboard of the wall (12) and the inner pipes communicate with an air chamber (27) surrounding the water jacket.

10. The incinerator of claim 6 wherein there are four such air supply pipe units (20), at 90° intervals about the chamber and wherein the longitudinally-extending portions (26) are sufficiently inboard of the inner wall (12) to provide air for effective combustion throughout the chamber.

* * * * *